US006526606B2

(12) United States Patent
Friedrich

(10) Patent No.: US 6,526,606 B2
(45) Date of Patent: Mar. 4, 2003

(54) SUPINE POSITION ASSIST APPARATUS FOR ADJUSTING THE POSITION OF A PERSON ON A BED

(75) Inventor: Joachim W. A. Friedrich, Hamburg (DE)

(73) Assignee: Deutsch Muskelschwund-Hilfe e.V. (DE)

( * ) Notice: Subject to any disclaimer, the term of this patent is extended or adjusted under 35 U.S.C. 154(b) by 0 days.

(21) Appl. No.: 09/858,338

(22) Filed: May 15, 2001

(65) Prior Publication Data

US 2002/0010960 A1 Jan. 31, 2002

(30) Foreign Application Priority Data

May 15, 2000 (DE) ..... 200 08 690 U

(51) Int. Cl.[7] ..... A61G 7/08
(52) U.S. Cl. ..... 5/81.1 R; 5/81.1 HS
(58) Field of Search ..... 5/81.1 R, 88.1, 5/89.1, 81.1 C, 81.1 HS, 81.1 RE

(56) References Cited

U.S. PATENT DOCUMENTS 4,716,607 A * 1/1988 Johansson ..... 5/81.1 T
4,776,047 A 10/1988 DiMatteo
5,390,379 A 2/1995 Palmer, Jr. et al.

* cited by examiner

*Primary Examiner*—Heather Shackelford
*Assistant Examiner*—Fredrick Conley
(74) *Attorney, Agent, or Firm*—R W Becker & Associates; R. W Becker

(57) ABSTRACT

A supine position assist apparatus, for adjusting the bed position of a person in the group of bed bound persons whose movement on or onto the bed is relatively the most severely hindered is provided and includes a first re-positioning movement element for moving the shoulder region of the bed bound person relative to the bed in a transverse direction perpendicular to the longitudinal extent of the bed, and a second re-positioning movement element. The re-positioning movement elements each include a pull cloth which is movable transversely. The second re-positioning movement element moves the back region of the bed bound person relative to the bed in a transverse direction perpendicular to the longitudinal extent of the bed. The first re-positioning movement element and the second re-positioning movement element are movable independent of each other.

15 Claims, 4 Drawing Sheets

SUPINE POSITION ASSIST APPARATUS FOR ADJUSTING THE POSITION OF A PERSON ON A BED

BACKGROUND OF THE INVENTION

The present invention relates to a supine position assist apparatus for adjusting the position of a person on a bed and, in particular, a supine position assist apparatus for adjusting the position of that group of bed bound persons whose movement on or onto the bed is relatively the most severely hindered, whereby the supine position assist apparatus includes at least two re-positioning movement means extending longitudinally relative to a bed operable to adjust the bed bound person transversely to the bed with a first one of the re-positioning movement means adjusting the shoulder region of the person and a second one of the re-positioning movement means adjusting the back region of the person independent of the operation of the first re-positioning movement means.

Those persons in the group of bed bound persons whose movement on or onto the bed is relatively the most severely hindered, such as persons with muscle illnesses, those with multiple sclerosis, or other bed bound patients who find themselves bed bound are often not capable of adjusting their position on the supine position surface of a bed in a targeted manner. Frequently, persons suffering from an illness of a type which impairs their control of their muscles twist and turn to such a degree that the twisting of the spinal column leads to great pain. In particular during sleeping, it is necessary to frequently correct this positioning. In this regard, however, the assistance of one, if not two, persons is frequently necessary. The supine position assist apparatus described in U.S. Pat. No. 5,390,379 is intended to facilitate the re-positioning of a patient on a bed or other similar supine position surface. The re-positioning movement means of this supine position assist apparatus is comprised of elements of a multiple piece mattress. These mattress elements, upon which the bed bound person lies, can be shifted within certain limits transversely to the longitudinal direction of the bed by means of pull elements in the form of cloth structures which are rolled over, or wound onto and from, rollers extending longitudinally of the bed. With this arrangement, it is possible to independently adjust transversely to the bed the shoulder and back regions of the bed bound person whose adjustment is critical. In particular, persons who are sleeping have a tendency during the quiet time of sleep to repeatedly assume the same uncomfortable position on the bed so that repeated corrections of the position of the person are required. However, it is not possible with conventional supine position assist apparatus to displace the elements of the mattress which form the supine position surface of the bed toward the side of the bed in a desired frequent and wide ranging manner without, for example, causing the mattress elements to extend laterally beyond the side edges of the bed.

A supine support device is described in DE 36 14 572 A1 having a single pull sheet on which the bed bound person lies which is displaceable transversely to the bed, whereby a turning and, on occasion, a transfer of the bed bound person to another support supine surface, is possible by displacement movement of the pull sheet. A re-positioning or adjustment of the position of the patient on such a support supine device is, however, not possible. For those bed bound persons suffering from muscle illnesses, it is not merely sufficient to provide the possibility to turn the bed bound person but, rather, it is necessary to achieve a positioning of the bed bound person on the bed in a straight position or in a position which is comfortable for the bed bound person.

SUMMARY OF THE INVENTION

The present invention offers a solution to the challenge of providing a supine position assist apparatus for a bed which not only can turn a person lying on the bed but which can also permit a repetitive re-adjustment of the position of the person to an original position relative to the bed.

In accordance with the present invention, a supine position assist apparatus is provided which offers an improvement over conventional supine position assist apparatus in that the re-positioning movement means of the supine position assist apparatus of the present invention comprises pull cloths on which the person lies and which are displaceable transversely to the bed.

With the pull cloths of the re-positioning movement means of the inventive supine position assist apparatus, which are preferably formed as continuous or endless cloth loops and which can be guided by rollers extending along the side of the bed, it is possible to repetitively effect a positioning of the bed bound person from a given orientation into practically any desired position in view of the fact that no element comprised in the bed is shifted during such deployment of the repositioning movement means so as to project laterally beyond a side of the bed.

If, for example, the bed bound person is lying in a curved position on the bed such that the bed bound person's shoulder region lies to the left and the bed bound person's back region lies to the right, the bed bound person can be restored to a position aligned with the longitudinal extent of the bed by a movement of a first re-positioning movement means toward the right and a movement of a second re-positioning movement means toward the left, as the positioning range of the pull cloths is very large.

In another embodiment of the supine position assist apparatus of the present invention, the pull cloths are windable onto, or unwindable from, a roller on a longitudinal side of the bed onto or from, respectively, another roller on an opposed longitudinal side of the bed, whereby the tension or stiffness of the pull cloths between the rollers can be adjustably varied and, consequently, the hardness of the supine position surface can be accommodated to the needs of the bed bound person.

The re-positioning movement means can be configured so as to support the movement of the bed bound person into a supine position or can alternately be configured so as to fully perform this movement. Moreover, it can be provided that the bed bound person can himself or herself execute the control of these movements or the movement control can be accomplished by a care provider. Furthermore, a control device can be made available at the edge of the bed or on the bed frame which de-activates the re-positioning movement means in the event that the re-positioning movement means reaches or exceeds a prescribed pressure so that, in this manner, the bed bound person is not moved off the bed in the event of a defective movement sequence or is otherwise injured by the re-positioning movement means.

The configuration of the re-positioning movement means as pull cloths on which the bed bound person moves has generally proved itself, is not overly sensitive to disturbances, and makes possible the fabrication of a compact supine position assist apparatus which can be installed onto conventional beds of the type found in private facilities. Additionally, the bed bound person is not disturbed by this re-positioning movement means configuration.

In accordance with a preferred embodiment of the supine position assist apparatus of the present invention, at least one other re-positioning movement means in the form of a third re-positioning movement means is arranged in the region of the legs of the bed bound person in order to move the legs transversely to the bed independent of the movements of the first and second re-positioning movement means. In this manner, an even more flexible positioning of the bed bound person on the bed can be effected, as the movement of the legs of a bed bound person is often not possible or is possible only with great effort. This third re-positioning movement means can comprise side or lateral pusher elements which engage the legs of the bed bound person. The provision of such pusher elements offers the advantage that the legs of the bed bound person can be maintained in the middle of the bed as the bed bound person sleeps instead of being at liberty to shift toward the outside edges of the bed. The risk that a bed bound person might fall out of the bed, as could arise with a bed construction having open sides, is thus prevented or, at least, substantially reduced.

In another useful embodiment of the supine position assist apparatus of the present invention, the third re-positioning movement means, with its associated lateral pusher elements, can be pivotably mounted to the bed below the supine resting position plane. This offers the advantage that movement of the bed bound person onto and off the bed is not hindered by the re-positioning movement means.

In connection with a further advantageous embodiment of the supine position assist apparatus of the present invention, it has proven to be advantageous to mount the re-positioning movement means to be adjustably re-positionable along the longitudinal direction of the bed to thereby permit the supine position assist apparatus to be accommodated to bed bound persons of differing sizes.

The re-positioning movement means is preferably driven in an electro-motor, hydraulic, or pneumatic manner. As a basic concept, however, a manual drive or a manual assist can be provided. Additional control elements can be provided to permit movement of the re-positioning movement means independent of one another. It can be advantageous to provide control means in order to drive at least the first and second re-positioning movement means synchronously in one direction at substantially the same speed. In this regard, a turning over of the bed bound person is possible, in addition to straightening the bed bound person out on the bed.

The control means can comprise a voice responsive control device. In this manner, the provision of care to the bed bound person is substantially facilitated if, for example, the bed bound person, in a given supine position on the bed, cannot reach, or can reach only with effort, the control device.

The present invention also involves a bed for a bed bound person having a supine position assist apparatus of the present invention. To further enhance the comfort of the bed bound person, a bed entry assist can be provided on at least one side of the bed which comprises a support plate for the placement thereon of the bed bound person's feet, the support plate being mounted on a pivot arm pivotably mounted to the bed in a manner such that the support plate can be disposed at the level of the supine position surface. In this manner, it is possible to substantially facilitate the laborious effort needed to raise the legs of the bed bound person as the bed bound person moves onto the bed. It is to be understood that this bed entry assist can also be deployed to assist the bed bound person in exiting the bed or in assuming a sitting position on the bed. The bed entry assist can be manually driven or driven by a motor.

In another embodiment of the supine position assist apparatus of the present invention, a fourth re-positioning movement means can be provided to enable at least one longitudinal side of the bed to be height adjustable such that the bed can be tilted to facilitate entry onto, and exit from, the bed. In this manner, the exit movement, in particular, of a bed bound person from the bed can be substantially facilitated.

BRIEF DESCRIPTION OF THE DRAWINGS

The object and advantages of the present invention will be explained in more detail with the aid of the accompanying drawings, in which.

DETAILED DESCRIPTION OF THE PREFERRED EMBODIMENT

Figure 1:
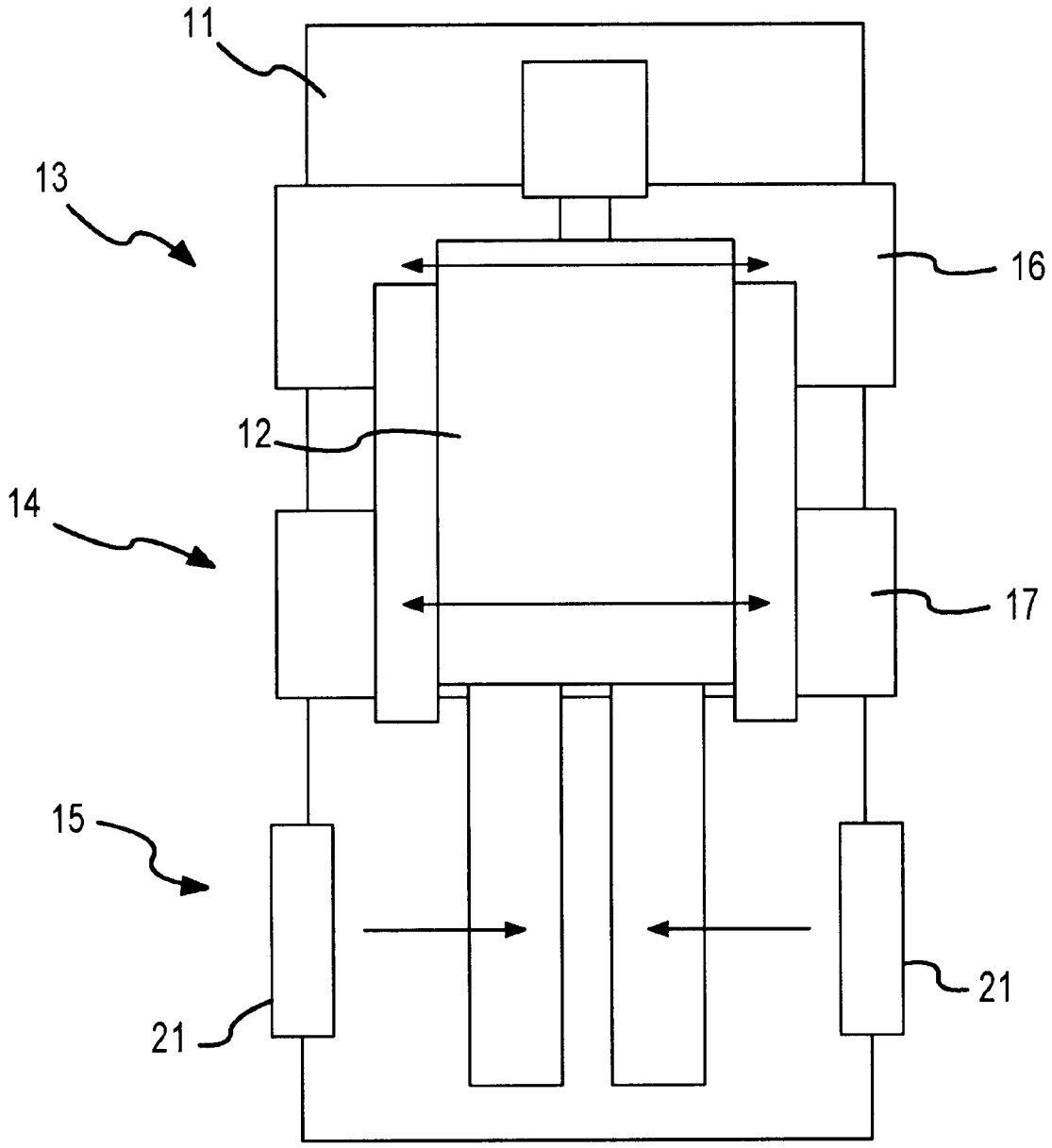
FIG. 1 is a top plan view of a bed having one embodiment of the supine positioning assist apparatus of the present invention.

FIG. 1 shows one embodiment of the supine positioning assist apparatus of the present invention deployed on a bed 11 for assisting in the positioning of a bed bound person 12 on the bed. The supine position assist apparatus comprises a first re-positioning movement means 13, a second re-positioning movement means 14, and a third re-positioning movement means 15 which make possible movement of the bed bound person relative to the bed in a direction transverse to the longitudinal extent of the bed.

With regard to the details of the components of the one embodiment of the supine positioning assist apparatus of the present invention shown in FIG. 1, the first re-positioning movement means 13 is arranged for engaging the shoulder region of the bed bound person, the second re-positioning movement means 14 is arranged for engaging the back region of the bed bound person, and the third re-positioning movement means 15 is arranged for engaging the legs of the bed bound person. In this manner, it is possible, for example, to adjust, through corresponding movement of the re-positioning movement means, the position of the bed bound person from a curved or angled supine position to a longitudinally aligned supine position.

Figure 2A:
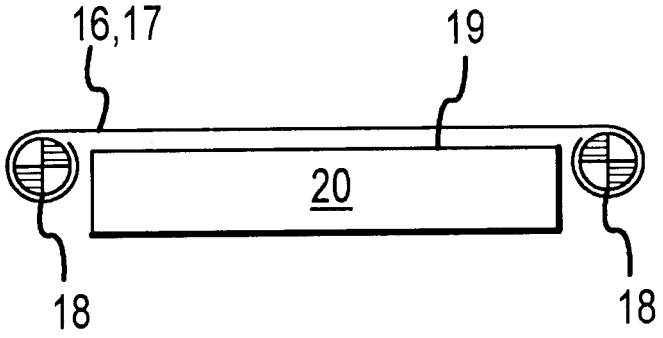
FIGS. 2*a*–2*d* are each respective end elevational views of a bed having different embodiments of the supine position assist apparatus of the present invention.

The first re-positioning movement means 13 and the second re-positioning movement means 14 are identically configured and include pull cloths 16, 17, respectively, on which the bed bound person lies and which can be pulled transversely over the supine position surface 19 while trained over rollers 18 extending longitudinally along the sides of the bed 11. In this manner, the bed bound person is provided with an assist in moving relative to the bed which makes it possible for the bed bound person to shift into a longitudinally aligned or curved supine position. The pull cloths, at least on their sides facing the supine position surface 19, which may be, for example, a mattress, are preferably provided with a smooth or low friction coating. FIGS. 2*a*–2*d* show various embodiments of the supine position assist apparatus of the present invention having differing configurations for guiding the movement of the pull cloths 16, 17. FIGS. 2*a* and 2*c* show an embodiment of the supine position assist apparatus in which the pull cloth is windable onto, or unwindable from, a roller 18 in order to thereby effect the re-positioning movement of the bed bound person.

Figure 2B:
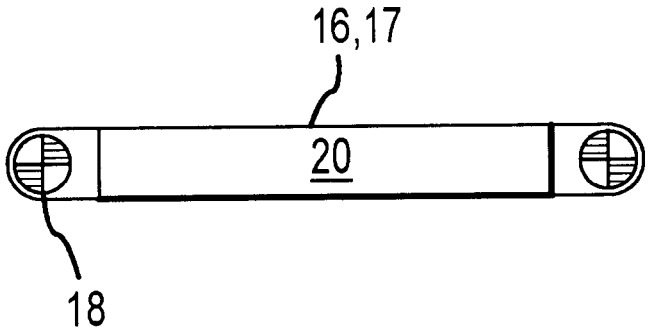
Figure 2C:
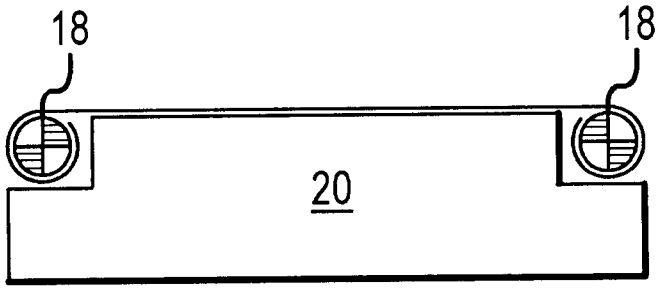
Figure 2D:
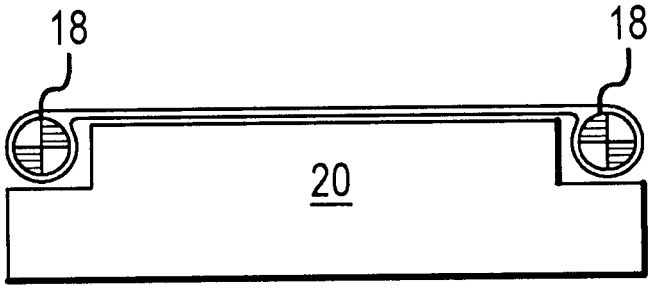

The pull cloths of the embodiment of the supine position assist apparatus shown in FIGS. 2*b* and 2*d* are configured as continuous or endless loops trained around rollers 18. In the embodiment of the supine position assist apparatus shown in FIG. 2*b*, the pull cloth is guided around the mattress 20, while in the embodiment of the supine position assist apparatus shown in FIG. 2*d*, the pull cloth is guided in a doubled up track across the top of the mattress. The rollers 18 in the two embodiments of the supine position assist apparatus shown in FIGS. 2*c* and 2*d* are mounted in recesses formed in the mattress 20, whereby a smaller overall structure is achieved.

The third re-positioning movement means 15 comprises lateral pusher elements 21 operable to engage the legs of the bed bound person to dispose them in the desired position on the bed. Also, these lateral pusher elements 21 maintain the thus disposed legs in the desired centered position on the bed. It is to be understood that additional re-positioning movement means can be provided, deployed along the longitudinal direction of the bed, whereby an individual accommodation of the supine position assist apparatus to the supine position and the needs of the bed bound person is possible.

The bed shown in FIG. 3 can be provided additionally or in the alternative with a bed entry assist 22 which comprises a foot support plate 23 which is mounted to a lift arm 24 that is, in turn, pivotably mounted to the bed. The feet of the bed bound person can be placed on the foot support plate 23 and raised thereby to a supine position surface level 25. The lift arm 24 can be manually driven or driven by a motor. The foot support plate 23 is preferably pivotably connected to the lift arm 24 in order to thereby continuously assume a comfortable orientation for the bed bound person's feet during the foot raising operation. In this manner, the often tiring task for the bed bound person of raising the legs is facilitated.

Figure 3A:
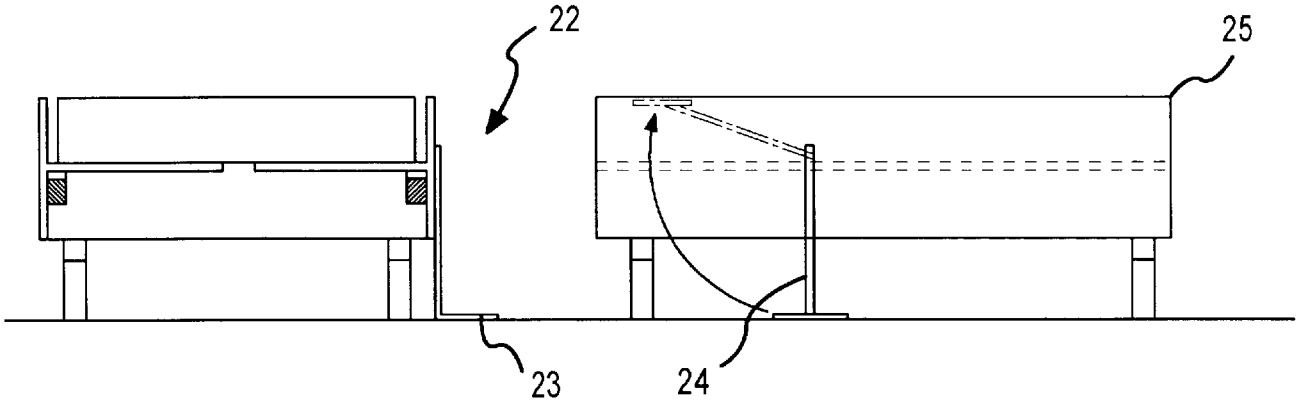
FIGS. 3*a*–3*b* are each end elevational views of a bed having respective different embodiments of the supine position assist apparatus of the present invention having a bed entry assist.
Figure 3B:
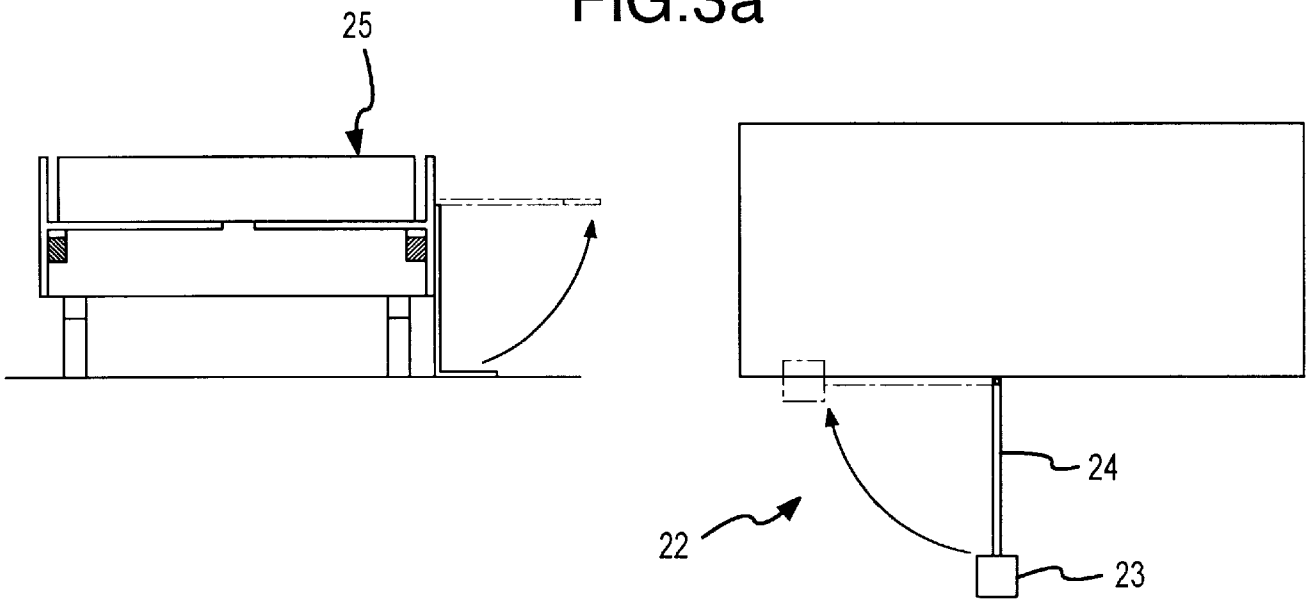

FIG. 3*a* shows an embodiment of the supine position assist apparatus of the present invention at an operational stage at which the lift arm 24 has been pivoted to a position parallel to the longitudinal side of the bed. FIG. 3*b* shows the movement of the lift arm 24 through an initial stage in which the lift arm is moved perpendicular to the longitudinal side of the bed and thereafter through a following stage in which the lift arm is pivoted, in its raised position, toward the bed. The pivot movement of the lift arm 24 toward the bed can also be accomplished from an intermediate position.

Figure 4A:
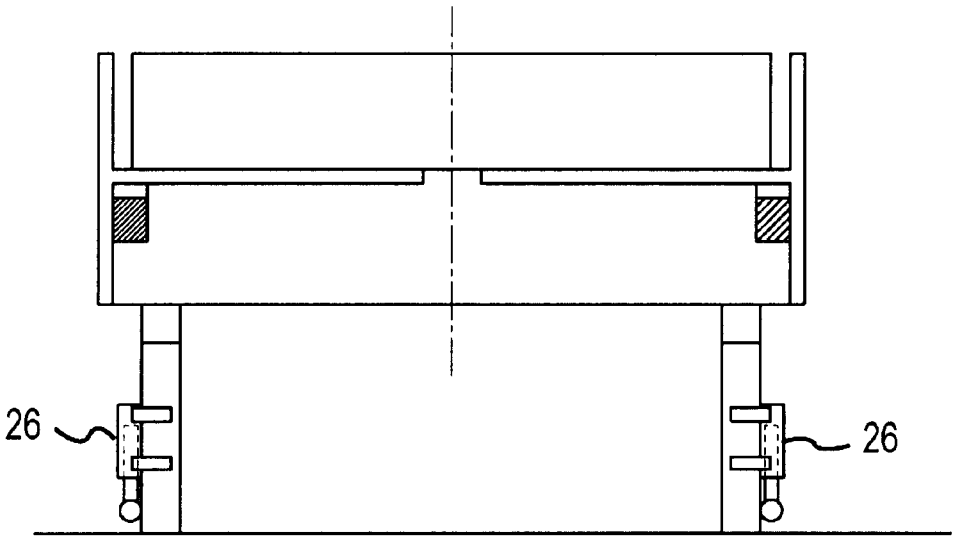
FIG. 4*a* is an end elevational view of a bed having an embodiment of the supine position assist apparatus of the present invention having a bed entry assist and showing the bed entry assist in its non-tilting position.
Figure 4B:
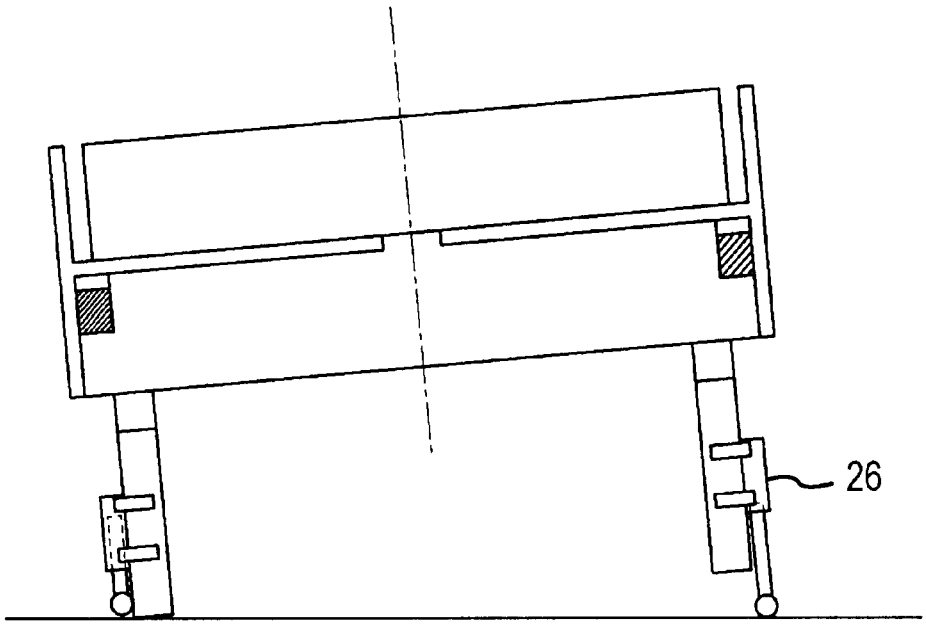
FIG. 4*b* is an end elevational view of the bed shown in FIG. 4*a* showing the bed entry assist in its bed tilting position.

FIG. 4*a* shows an embodiment of the supine position assist apparatus of the present invention having a bed exit assist. The bed exit assist comprises a fourth re-positioning movement means 26 which can be extended outwardly in order to raise the bed on one longitudinal side thereof. FIG. 4*b* shows the bed in this raised position. The re-positioning movement means 26 can comprise, for example, a piston and cylinder drive or a spindle drive. The raising of the bed in such a manner considerably facilitates, in particular, the exit movement of the bed bound person from the bed.

A bed provided with the supine position assist apparatus of the present invention permits a bed bound person who may, for example, be suffering from a muscle condition, to orient and turn his or her body on the bed in a self directed manner. In particular with the deployment of a voice responsive control device, a bed bound person can be moved from practically any position into any desired pain relieving position and orientation. The comfort of the bed bound person in the supine position is thus clearly improved.

The specification incorporates by reference the disclosure of German priority document 200 08 690.1 of May 15, 2000.

The present invention is, of course, in no way restricted to the specific disclosure of the specification and drawings, but also encompasses any modifications within the scope of the appended claims.

What I claim is:

1. A supine position assist apparatus for adjusting the bed position of a person in the group of bed bound persons whose movement on or onto the bed is relatively the most severely hindered, the bed having a longitudinal extent, comprising:

a first re-positioning movement means for moving the shoulder region of the bed bound person relative to the bed in a transverse direction perpendicular to the longitudinal extent of the bed, the first re-positioning movement means having a pull cloth on which the shoulder region rests which is movable transversely; and a second re-positioning movement means for moving the back region of the bed bound person relative to the bed in a transverse direction perpendicular to the longitudinal extent of the bed, the second re-positioning movement means having a pull cloth on which the back region rests which is movable transversely, the first re-positioning movement means and the second re-positioning movement means being movable in one of a selected one of an interdependent manner with one another and a manner in which each re-positioning movement means is moved independent of the movement of the other re-positioning movement means.

2. A supine position assist apparatus for adjusting the bed position of a person in the group of bed bound persons whose movement on or onto the bed is relatively the most severely hindered according to claim 1, and further comprising a third re-positioning movement means for moving at least one leg of the bed bound person transversely relative to the bed, the third re-positioning movement means being movable in a selected one of an interdependent manner with respect to both of the first re-positioning movement means and the second re-positioning movement means and a manner in which the third re-positioning movement means is moved independent of at least one of the first re-positioning movement means and the second re-positioning movement means.

3. A supine position assist apparatus for adjusting the bed position of a person in the group of bed bound persons whose movement on or onto the bed is relatively the most severely hindered according to claim 2, and further comprising lateral pusher elements operable to engage at least one leg of the bed bound person to selectively transversely push the leg or prevent the leg from movement in a transverse direction.

4. A supine position assist apparatus for adjusting the bed position of a person in the group of bed bound persons whose movement on or onto the bed is relatively the most severely hindered according to claim 3, wherein at least one of the third re-positioning movement means and the lateral pusher elements is pivotally mounted to the bed below the supine position surface.

5. A supine position assist apparatus for adjusting the bed position of a person in the group of bed bound persons whose movement on or onto the bed is relatively the most severely hindered according to claim 2, wherein at least one of the first re-positioning movement means, the second re-positioning movement means, and the third re-positioning movement means is mounted for longitudinal adjustment of its position relative to the bed.

6. A supine position assist apparatus for adjusting the bed position of a person in the group of bed bound persons whose movement on or onto the bed is relatively the most severely hindered according to claim 1, and further comprising rollers mounted on at least one side of the bed, wherein the pull cloths are trained over the rollers.

7. A supine position assist apparatus for adjusting the bed position of a person in the group of bed bound persons whose movement on or onto the bed is relatively the most severely hindered according to claim 1, wherein the pull cloths are each in the form of an endless loop.

8. A supine position assist apparatus for adjusting the bed position of a person in the group of bed bound persons whose movement on or onto the bed is relatively the most severely hindered according to claim 1, and further comprising a roller mounted on one side of the bed and a roller mounted on the other side of the bed, wherein at least one of the pull cloths is trained around the pair of rollers in a manner such that the pull cloth is unwound from one of the rollers in coordination with the winding up of the pull cloth onto the other roller.

9. A supine position assist apparatus for adjusting the bed position of a person in the group of bed bound persons whose movement on or onto the bed is relatively the most severely hindered according to claim 1, wherein at least one of the first re-positioning movement means and the second re-positioning movement means is drivable by a selected one of an electro-motor drive, a manual drive, a hydraulic drive, and a pneumatic drive.

10. A supine position assist apparatus for adjusting the bed position of a person in the group of bed bound persons whose movement on or onto the bed is relatively the most severely hindered according to claim 1, and further comprising a control device operatively connected to at least one of the first re-positioning movement means and the second re-positioning movement means for controlling at least one of the thereto connected re-positioning movement means to move in synchronization at substantially the same speed as the other re-positioning movement means such that a turning of the bed bound person is effected.

11. A supine position assist apparatus for adjusting the bed position of a person in the group of bed bound persons whose movement on or onto the bed is relatively the most severely hindered according to claim 1, and further comprising a control device to control the movements of the first re-positioning movement means and the second re-positioning movement means independent of one another.

12. A supine position assist apparatus for adjusting the bed position of a person in the group of bed bound persons whose movement on or onto the bed is relatively the most severely hindered according to claim 11, wherein the control device is voice responsive.

13. A bed comprising:

a supine position surface having a longitudinal extent on which a bed bound person can lie in a supine position;

a first re-positioning movement means for moving the shoulder region of the bed bound person relative to the bed in a transverse direction perpendicular to the longitudinal extent of the bed, the first re-positioning movement means having a pull cloth on which the shoulder region rests which is movable transversely; and a second re-positioning movement means for moving the back region of the bed bound person relative to the bed in a transverse direction perpendicular to the longitudinal extent of the bed, the second re-positioning movement means having a pull cloth on which the back region rests which is movable transversely, the first re-positioning movement means and the second re-positioning movement means being movable in one of a selected one of an interdependent manner with one another and a manner in which each re-positioning movement means is moved independent of the movement of the other re-positioning movement means.

14. A bed according to claim 13, and further comprising a bed entry assist having a lift arm pivotally mounted to the bed and a foot support plate mounted to the lift arm and serving for supporting thereon the feet of the bed bound person for lifting thereof to the level of the supine position surface.

15. A bed according to claim 13 and further comprising a re-positioning movement means arranged on a longitudinal side of the bed for adjustably raising and lowering the one longitudinal bed side relative to the other longitudinal bed side for facilitating entry and exit of the bed bound person relative to the bed.

* * * * *